US010267514B2

(12) United States Patent
Kornilov et al.

(10) Patent No.: US 10,267,514 B2
(45) Date of Patent: Apr. 23, 2019

(54) BRAIDED BURNER FOR PREMIXED GAS-PHASE COMBUSTION

(71) Applicants: Viktor Mykolayovych Kornilov, Geldrop (NL); Savad Shakariyants, Hertogenbosch (NL); Laurentius Philippus Hendrika de Goey, Budel (NL)

(72) Inventors: Viktor Mykolayovych Kornilov, Geldrop (NL); Savad Shakariyants, Hertogenbosch (NL); Laurentius Philippus Hendrika de Goey, Budel (NL)

(73) Assignee: Micro Turbine Technology B.V., Eindhoven (NL)

( * ) Notice: Subject to any disclaimer, the term of this patent is extended or adjusted under 35 U.S.C. 154(b) by 650 days.

(21) Appl. No.: 14/345,405

(22) PCT Filed: Sep. 17, 2012

(86) PCT No.: PCT/NL2012/050655
§ 371 (c)(1),
(2) Date: Mar. 17, 2014

(87) PCT Pub. No.: WO2013/039402
PCT Pub. Date: Mar. 21, 2013

(65) Prior Publication Data

US 2015/0147708 A1 May 28, 2015

(30) Foreign Application Priority Data

Sep. 16, 2011 (NL) ..... 2007429
Oct. 24, 2011 (NL) ..... 2007646

(51) Int. Cl.
*F23D 14/02* (2006.01)
*F23D 14/84* (2006.01)
(Continued)

(52) U.S. Cl.
CPC ..... *F23D 14/02* (2013.01); *F23D 14/14* (2013.01); *F23D 14/58* (2013.01); *F23D 14/84* (2013.01);
(Continued)

(58) Field of Classification Search
CPC ..... F23D 14/14; F23D 2212/201; F23D 2900/00019; F23D 2213/00; F23D 2203/104; F23D 2203/103; F23D 2203/1017; F23D 2212/103; F23D 14/16; F23D 14/26; F23D 3/40
USPC ..... 431/326, 350, 7, 329, 106, 110, 113, 22, 431/343
See application file for complete search history.

(56) References Cited

U.S. PATENT DOCUMENTS 3,857,670 A * 12/1974 Karlovetz ..... D06F 67/02 431/329
5,165,887 A * 11/1992 Ahmady ..... F23D 14/16 126/92 AC
(Continued)

FOREIGN PATENT DOCUMENTS

EP 0896190 7/1998
EP 0896190 A2 * 7/1998
(Continued)

*Primary Examiner* — Avinash Savani
*Assistant Examiner* — Rabeeul Zuberi
(74) *Attorney, Agent, or Firm* — Troutman Sanders LLP; Ryan A. Schneider; Micah B. Hensley

(57) ABSTRACT

A surface burner for gas combustion has a burner surface which is fabricated by intertwining or interweaving an elongated flexible element across a distinct burner frame. This fabrication method can be best referred to as braiding, but also plaiting, lacing or another comparable method.

10 Claims, 2 Drawing Sheets

(51) Int. Cl.
*F23D 14/14* (2006.01)
*F23D 14/58* (2006.01)

(52) U.S. Cl.
CPC .. *F23D 2203/103* (2013.01); *F23D 2203/104* (2013.01); *F23D 2203/1017* (2013.01); *F23D 2212/103* (2013.01); *F23D 2212/201* (2013.01); *F23D 2213/00* (2013.01); *F23D 2900/00019* (2013.01)

(56) References Cited

U.S. PATENT DOCUMENTS

| | | | | | |
|---|---|---|---|---|---|
| 5,832,715 | A * | 11/1998 | Dev | F01D 5/085 | 60/39.511 |
| 6,065,963 | A * | 5/2000 | Dewaegheneire | F23D 14/145 | 431/329 |
| 7,857,617 | B2 * | 12/2010 | O'Donnell | F23C 5/02 | 122/17.1 |
| 2006/0251998 | A1 * | 11/2006 | Lamberts | F23D 14/145 | 431/350 |
| 2009/0011270 | A1 | 1/2009 | Hsu | | |
| 2014/0106286 | A1 * | 4/2014 | Kim | F23G 7/065 | 431/202 |

FOREIGN PATENT DOCUMENTS

| | | | | | |
|---|---|---|---|---|---|
| GB | 190618152 | A * | 1/1907 | | |
| GB | 1440078 | A * | 6/1976 | F23D 14/12 | |

* cited by examiner

BRAIDED BURNER FOR PREMIXED GAS-PHASE COMBUSTION

TECHNICAL FIELD OF THE INVENTION

The invention relates to a burner for premixed gas-phase combustion having a flame stabilization surface comprising an elongated flexible element and a frame consisting of structural elements across which the elongated flexible element is braided, intertwined or interwoven such that segments of the element form openings on the burner surface in the form of curved and inclined flow channels of a variable cross section.

BACKGROUND OF THE INVENTION

Premixed combustion (typically, fuel lean) is a widely known approach for a clean/low-NOx gas-phase burning in various appliances. Fuel-rich premixed combustion is a method of fuel reforming and can be used as the $1^{st}$ combustion stage/zone. Incineration of ventilation gases is also routinely performed in the premixed flame regime.

The ultimate function of a burner for premixed combustion is to anchor and hold combustion in a dedicated zone. A premixed flame can be anchored via either 1) aerodynamic stabilization in reverse, stagnation or divergent flows; 2) surface stabilization by heat transfer, mass transfer and flame stretch; 3) submersion of the reaction layer into some porous matrix. The present invention is related to the second type of flame stabilization/attachment/holding method.

Several types of surface burners are known:

- Ceramic or metal felts or foams with open porosity. These burners can effectively anchor flat flames and flames following the contour of the burner surface. It is required that the unburned mixture flow velocity is not much higher than the corresponding adiabatic flame speed. There are many patents related to this burner type, e.g. U.S. Pat. No. 4,608,012, U.S. Pat. No. 5,511,974A.
- Perforated metal or ceramic burner decks. In this case, the flame is composed of many individual flames of close to conical shapes anchored at the edges of each hole or group of holes on a perforation pattern. Many different perforation patterns, deck materials and burner shapes are known and used, e.g. US2010273120A1, MX2010008176A, WO2011069839A1.
- Metal knitted burner. This burner type is made by tailoring the burner surface from a pre-fabricated metal cloth. The flame anchored on this type of burners combines features of the two flames described above: flat surface stabilized flames at the position of the metal cloth plies and irregular quasi-conical flames downstream openings on the cloth surface. Examples of such burners can be found in: WO0179758A1, USD610870S1, WO0179756A1.

Other knitted or woven burners are known, such as in US20090011270. Such burners use textile articles. Elements of the textile article cross each other, as the article is pre-fabricated and then tailored to the burner hardware. Elements of the textile article, therefore, do not cross hardware elements of the burner.

Various combinations of the burners described above are also known: Bekaert (CA2117605A1) or Alzeta (WO2010120628A1—a burner deck made from metal wool felt locally perforated by holes and/or slits). Alzeta burners were tested for gas turbine application (trade name "Nano-STAR") wherein combustion takes place at an elevated inlet temperature and high pressure.

Surface stabilized combustion has been also employed in devices that combine both a burner and a heat exchanger. Such devices can be distinguished by the presence of heat-exchange (or cooling) elements in their structures. Other parts can be used between the burner surface and the heat exchange elements as to maximize the transfer of heat released in combustion to the cooling medium. These parts can be implemented in the form of fillers, such as steel wool, foam, etc. A typical example of such a combined burner heat exchanger is a device according to EP-A-0 896 190. It consists of an elongated flexible element in the form of a yarn or thread, cooling elements and, optionally, steel wool.

Combined burner heat exchangers are excluded from further consideration in this patent, as they belong to a different scope, namely:

- Cooling affects combustion: a) Reduces burning temperature; b) Influences burning velocity; c) Changes flame stabilization mechanisms; d) Changes characteristic of flashback and blow-off; and e) Changes combustion dynamics and noise.
- Cooling reduces hardware temperature.
- Cooling affects design, construction and operability due to the effects on combustion and hardware given above.
- Combined burner heat exchangers cannot be used in applications where the heat released in combustion has to remain in the products of combustion: such as in engine combustion chambers.

The following criteria are important for the performance evaluation of surface burners:

- Flame flashback resistance: This typically requires small perforation or interweaving holes.
- Oxidation resistance: This implies the use of high temperature materials, like ceramics or special alloys.
- Long-term reliability and structural integrity under the conditions of high temperature, thermal gradients, thermal shock and cyclic operation: One of the methods to satisfy this requirement is to allow some degree of spatial flexibility of the burner hardware.
- Wide range of thermal load: This implies a wide range of flow rate per unit surface. The lower flow limit is determined by either flame quenching, flash-back or limitations of the deck material (overheating, oxidation, etc.). The higher limit is determined by the flame blow-off or incomplete combustion.
- Low hydraulic resistance for low pressure drop: This requires high open porosity and a limited burner deck thickness (which is typically in conflict with measures to prevent flash-back).
- Acceptable emission characteristics (minimal CO, UHC and NOx concentrations): This is essentially determined by the flame temperature and residence time of burnt gases at high temperature.
- Cost effectiveness: This concerns material and production costs, relates to design simplicity and possibilities for manufacturing automation.

A synthesis of the criteria given above lead to the invention of a burner presented in this patent.

SUMMARY OF THE INVENTION

It is an object of the present invention to provide a surface burner that very effectively meets the criteria set for surface burners in the section above. To this end, the burner according to the invention is characterized in having an elongated flexible element, which is a trimming made of multiple strands of yarn twisted together such that segments of the element form curved and inclined flow channels of a variable cross section and openings between these segments on the burner surface, which is a flame stabilization surface.

The key idea of the innovation is as follows: The burner surface is fabricated by intertwining or interweaving the elongated flexible element of multiple strands of yarn twisted together across structural elements of the frame. Segments of this flexible element (trimming) form curved and inclined flow channels of a variable cross section and openings between these segments on the burner surface. This fabrication method can be best referred to as braiding, but also plaiting, lacing or another comparable method. This method does not imply any surface pre-fabrication in the form of a cloth, textile article or any other form, as common in knitted or woven burners known from the prior art.

Also, the burner according to the invention does not need to use any inserts (such as knitted wool, as known for the known prior-art burners).

The trimming into which the multiple strands of yarn are twisted can be referred to as a sleeve or by any other professional term. The elongated flexible element can be of metal, ceramic or other materials such as glass fiber, basalt, etc.

The frame can be (nearly) flat, 2-dimensional (an assembly of rods and closed shapes, such as circles, squares, etc.), as well as in various 3-dimensional shapes (in the form of a dome, concave, convex, an assembly of crossing and non crossing arches, etc.). The frame material can be metal, ceramic, quartz, basalt, etc.

The braided burner surface can be (nearly) flat, concave and convex, 2-dimensional and 3-dimensional. It can form a surface of rotation (e.g. cylinder, sphere, etc.). It can be composed of combination of various surface types and shapes (e.g. cylinder with a flat end surface, cylinder with a half-spherical end surface, etc.).

A comparison between braiding and tailoring/shaping of burner surfaces from a pre-fabricated cloth, felt or mat gives the following advantages:

- Braiding does not require material cutting. Therefore, it is not required to treat and fix the cutting edges. This is especially advantageous when ceramics are required for very high-temperature or other special applications.
- Braiding produces a kind of "nozzles" between the braids through the surface. These nozzle channels have a great degree of tortuosity, which is advantageous for flow distribution over the surface and flame stabilization.
- Braided surfaces do not require any extra supports or shape-forming structures, as knitted burners do.

A combustible fuel-air mixture is supplied to the burner surface. The mixture flows through the space between the braids and exits in the form of intricately inclined jets. The jets produce conical flames of variable turbulence intensity (the flows can vary between laminar and turbulent) and degree of stretching stabilized on the edges of the channel exits on the surface.

A part of the mixture can also filter through the braiding material. It then burns on the burner surface. This surface combustion assists the stabilization of the conical flames.

Flame stabilization is also improved by the tortuosity of the inter-braid channels, inherent variation of the channel flow diameter with a commonly present throat like in a convergent-divergent nozzle and mutual inclination of jets and the flame cones.

The braided burner according to the invention is very advantages for the following applications:

- premixed combustion;
- fuel-lean combustion;
- fuel-rich combustion;
- combustion at high-inlet temperatures; and
- combustion in such appliances as: gas turbines, recuperated and non-recuperated micro turbines, boilers (including domestic), heaters, dryers and other appliances.

An embodiment of the burner according to the present invention is characterized in that the structural elements of the frame are thinner than the elongated flexible element woven across these structural elements, and the flow channels between the elongated flexible element segments and openings on the flame stabilization surface are formed as to issue intricately inclined jets that produce flames when the combustible mixture flows through them. The combustible mixture is supplied towards the surface and the cord is made of the material through which a part of the mixture can filter in order to burn on the surface in the surface combustion mode.

A further embodiment of the burner according to the present invention is characterized in that the structural elements of the frame are no hollow cooling. As cooling elements are part of the known prior-art burners, heat is always transferred to the cooling medium in these cooling elements. Combustion is affected by heat rejection to the cooling medium via: a) Reduced burning temperature; b) Reduced burning velocity; c) Changed flame stabilization mechanisms; d) Changed characteristics of flashback and blow-off; and e) Changed combustion dynamics and noise. This heat rejection is prohibited (fundamentally impossible) in application that require heat retention in the products of combustion, such as in gas turbines. In a further embodiment of the burner according to the present invention the burner has the shape of a basket.

In yet another embodiment of the burner according to the present invention, the surface of the burner is formed by intertwining or interweaving an elongated flexible element (trimming) across the elements of a frame, which is supported by a holder, and these elements are an even number of full-U arches and one half-U arch.

Preferably, at least of number of U-arches comprise a bridging section and two leg sections essentially parallel to each other.

The burner may have a frame wherein the structural elements do not cross each other. It may also have a frame wherein the frame elements cross each other and form a cupola centre point.

BRIEF DESCRIPTION OF THE DRAWINGS

The invention will be further elucidated below on the basis of one particular embodiment illustrated in drawings, as well as plots containing measurement results, namely.

This embodiment of the invention is a burner fabricated and tested by the inventors. The burner in the invention is not limited to this embodiment.

DETAILED DESCRIPTION OF THE DRAWINGS

Figure 1:
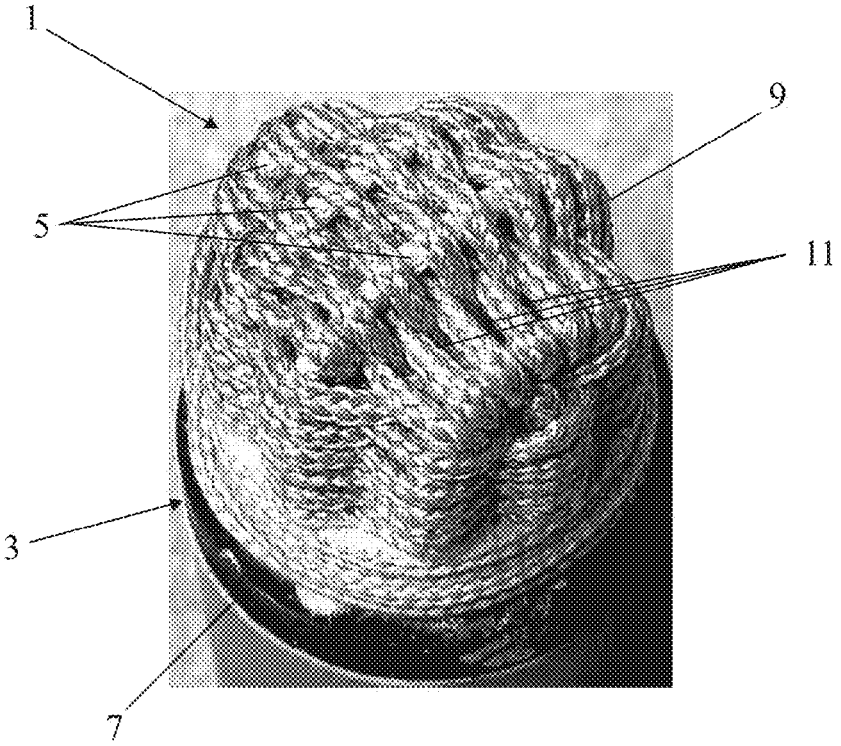
FIG. 1 shows a burner with ceramic fiber cord braided across a frame.

In FIG. 1, an embodiment of the burner 1 is shown. The burner surface is formed by an elongated flexible element formed by a cord 9 of flexible material braided into a pattern resembling a basket or a mitre headgear. The cord 9 is made of the high-temperature material that prevents burner failure at high inlet temperatures. The cord is braided around a frame 3 in FIG. 2.

Figure 2:
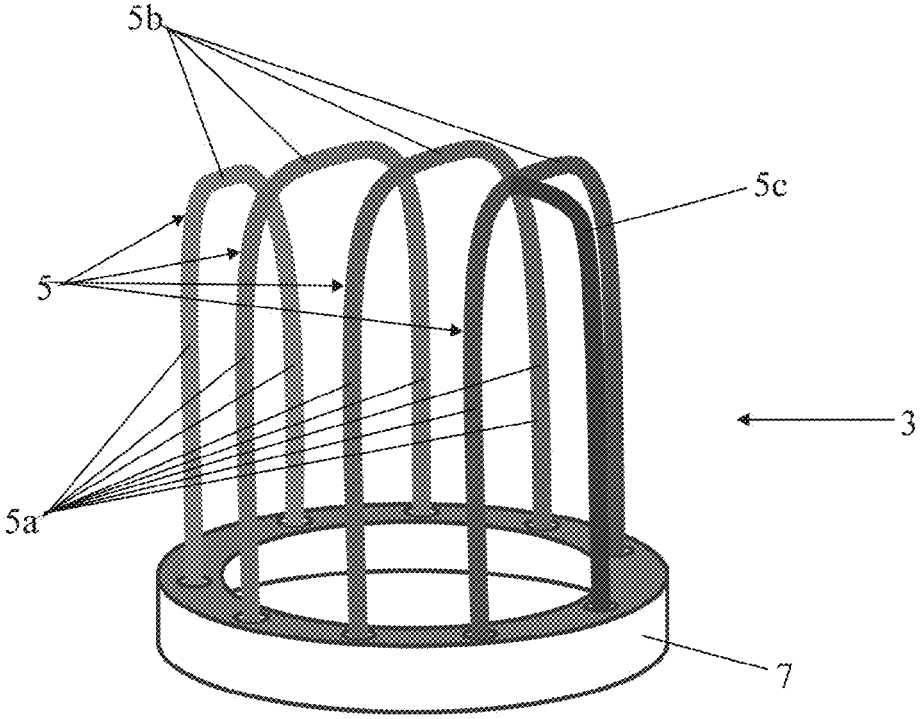
FIG. 2 shows the burner.

FIG. 2 shows a holder ring 7 of the burner frame. The holder ring diameter is 30 mm. In the illustrated embodiment, the frame is made from an even number (four) of full-U arches 5 and one half-U arch 5*c*. Each full-U arch comprises a bridging section 5*b* and two leg sections 5*a* essentially parallel to each other. The full-U arches 5 and one half-U arch 5*c* produce an odd (nine) number of vertical leg sections required for a favorable braiding pattern. Alternatively, the U arches could have crossed to form a cupola center point at the top. The material of the U arches of the burner in the illustrated embodiment is ceramics.

The braiding cord 9 in FIG. 1 is made from ceramics yarns, which are composed of ceramic fibers. It has the diameter of 2 mm in a non-stretched state. The surface porosity, size of openings between the cord segments 11, tortuosity of the flow channels formed between cord 9 segments and other surface/pattern parameters can be adjusted via a proper selection of the: 1) cord thickness; 2) frame parameters; 3) braiding pattern; and other available design parameters.

The burner presented in FIG. 1 has the external surface of approximately 33 $cm^2$. It is scaled for a thermal power range between single to more than 10 kWTh at room conditions.

Working Principle

The burner in FIG. 1 functions as follows: A premixed fuel-air mixture is supplied through the holder ring. The overall mixture flow is self divided over the burner surface into two parts: The larger flow portion passes with a higher speed between the cord segments (braids) and jets through the openings between the braids on the burner surface. The smaller portion filters through the fiber material of the braiding cord and burns on the cord surface. The high-speed jets produce conical flames. These flames are additionally stabilized by the surface combustion. The stabilization is improved by the tortuosity of the space available to the flow between the braids and the mutual inclination of the mixture jets and the flame cones. Due to such effective flame stabilization, the flow range between flame quenching and blow-off is very wide. The braiding ensures that each individual jet channel is formed almost as a nozzle with a throat. The latter ensures a high resistance of the burner surface against flashback. The cord fiber and braiding easily allow accommodating thermal and mechanical stresses. In this way, resistance to thermal expansion and thermal shock is ensured. High thermal resistance and oxidation resistance of the ceramic fiber allow operating the burner at very high surface/material temperatures.

Typical Burner Performance

Figure 3:
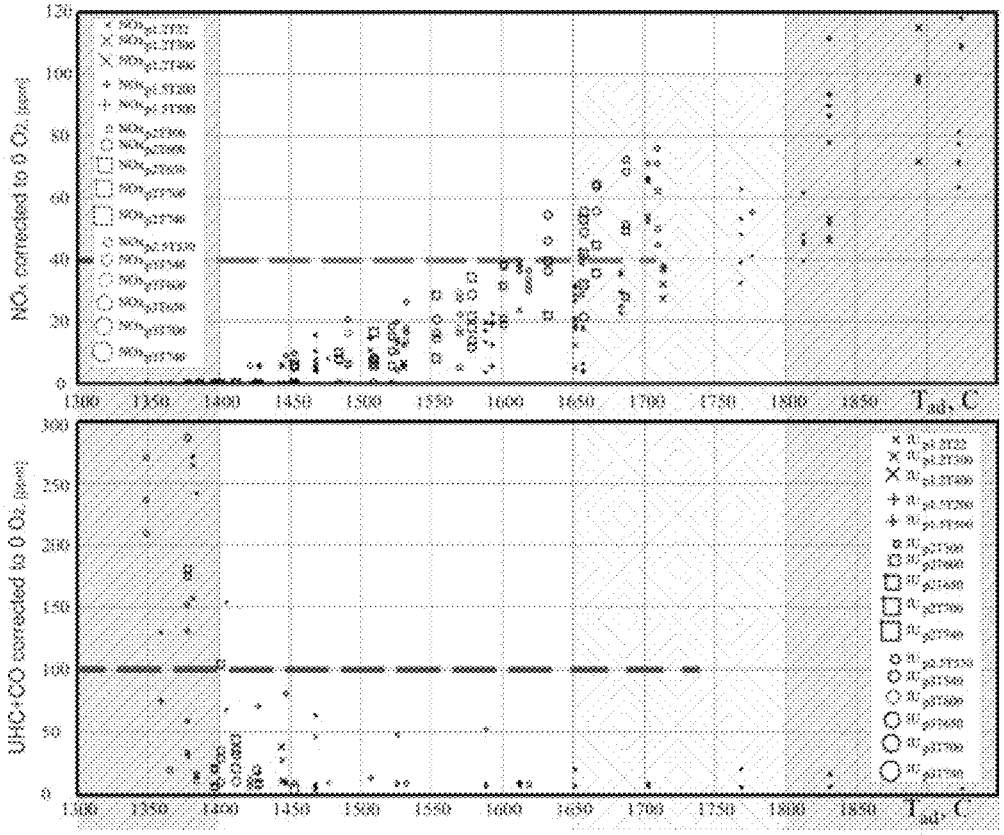
FIG. 3 shows a plot of measured mole fractions of NOx and unburned species versus calculated adiabatic flame temperature.

Some experimentally measured performance figures for the burner in FIG. 1 are described below in the following plots:

FIG. 3: Measured (corrected to zero oxygen) mole fractions of NOx and unburned species (CO+UHC) versus calculated adiabatic flame temperature ($T_{ad}$). Experiments are conducted for various inlet temperatures (T22-T740—correspond to 22-740 deg. C.), absolute pressures (p1-p3 in bar), flow rates (100-1000 Nl/min) and mixture equivalence ratios (0.28-0.95).

Figure 4:
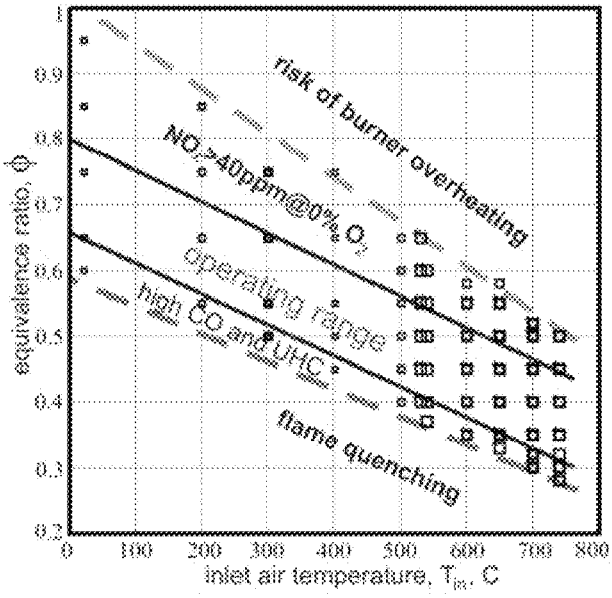
FIG. 4 shows a plot of optimal and allowable mixture equivalence ratio versus inlet temperature.

FIG. 4: Optimal (between solid lines) and allowable (between dashed lines) mixture equivalence ratio versus inlet temperature at absolute pressure 1-3 bar. Markers represent experimental points.

As can be seen from FIG. 3 and FIG. 4, the burner was tested for combustion of premixed methane-air mixture over variable: inlet temperature, pressure, flow rate and mixture equivalence ratio (actual fuel-to-air flow ratio divided by the stoichiometric ratio). The burner was installed inside a quartz tube (to provide optical observation) with a diameter of 110 mm and extended over ~150 mm from the burner base. The inlet temperature and absolute total pressure varied between room temperature and atmospheric pressure and 740 C and 3 bar respectively. The mass flow rate and fuel-to-air equivalence ratio varied from 100 to 1000 Nl/min (~2-20 g/s) and 0.28 to 0.95 (depending on the inlet temperature) respectively. The thermal input ranged from >4 to 32 kWTh.

Combustion completeness was evaluated for the burner in FIG. 1 via measuring mole fractions of CO and unburned hydrocarbons (UHC). NOx was also measured in all tested cases. FIG. 3 shows an index of unburned species (IU) defined as: IU=[CO]+[UHC] (ppm) and $NO_x$ mole fractions at zero oxygen concentration versus adiabatic flame temperature $T_{ad}$. The adiabatic flame temperature is calculated as a function of the inlet temperature and equivalence ratio at each given pressure.

If one would adopt the limits of NOx <40 ppm and IU<100 ppm (at zero $O_2$), then in the range of adiabatic flame temperatures between ~1450 C and ~1650 C both IU and NOx can be maintained below these limits. The right adiabatic temperature can be ensured by a proper adjustment of the mixture equivalence ratio as a function of the mixture inlet temperature. Between solid lines in the middle of FIG. 4, low-emission operation can be achieved. The upper and lower dashed lines indicate the allowable operating range. The markers in FIG. 4 represent experimental points. The experiments prove that the burner can also operate at high equivalence ratios. This will, however, result in higher adiabatic flame temperatures and high NOx. The flame temperatures up to the melting/oxidation temperature limit of the burner surface material are safe (in this example up to 1800 C): The burner cannot be destroyed even if the flame will closely approach or even partially submerge into the surface. The burner can be operated at even higher combustion temperatures. However, for these regimes, special attention should be paid to avoiding an overheating of the burner material.

Application at Elevated Inlet Temperatures and Pressures

FIGS. 3 and 4 demonstrate experimental evidence that the burner according to the invention has a broad applicability range stretching from atmospheric (room) conditions and up to elevated pressures and inlet temperatures, including very high inlet temperatures.

Among other appliances, elevated pressures and inlet temperatures are encountered in burners for gas turbine combustion, as a result of flow compressor. The inlet temperature can be further increased in a gas-turbine recuperator, which recuperates exhaust heat into the compressed flow. Recuperators are used on various gas turbines and commonly used on micro turbines.

Premixed gas turbine burners are susceptible to flashback. Compared to other premixed burners, the flashback problem is more acute in gas turbines due to a broad range of operating conditions with varying pressures, inlet temperatures, flow rates and equivalence ratios. It is very difficult to ensure that conditions for a flashback will not occur within such a variation of operating conditions. Combinations of burners and recuperators, as well as other heat exchanges, are also encountered in other applications, including high-efficiency furnaces, boilers, etc.

High inlet temperatures further promote flashback. As the inlet flow is hot and lacks the cooling capacity, any upstream flame propagation typically leads to a very rapid burner failure.

The burner according to the invention has a superior flashback resistance, as any upstream flame propagation is counteracted by flow streams accelerated though the intricately inclined flow channels between the cord braids that terminate into openings on the burner surface. Additionally, the suitability of high-temperature materials (such as ceramics, high-temperature alloys, quartz and glass fibers, etc.) for the burner cord greatly extends possibilities for operation at very high inlet temperatures with reduced risks of burner failure. These statements are proven by the flashback-free operation and retention of structural integrity of the tested burners (FIG. 1-FIG. 4), including low NOx, CO and UHC operation.

Therefore, the burner in this patent is proven to be ideally suitable—but not limited to—applications at high inlet temperatures, such as in recuperated appliances, including gas turbines and micro gas turbines. The latter also feature elevated pressures.

Although the present invention is elucidated above on the basis of the given drawings, it should be noted that this invention is not limited whatsoever to the embodiments shown in the drawings. The invention also extends to all embodiments deviating from the embodiments shown in the drawings within the context defined by the description and the claims.

What is claimed is:

1. A burner for pre-mixed gas-phase combustion, the burner comprising:

an elongated flexible element made of multiple strands of ceramic yarn twisted together; and a frame comprising:

a holder having a first surface, a second surface, an outer wall, and an inner wall defining an aperture; and structural elements comprising:

a plurality of full-U-shaped arches, each full-U-shaped arch including two legs and each leg extending from the first surface of the base in a substantially perpendicular direction with respect to the first surface; and a single half-U-shaped arch having a leg and a distal end opposite the leg, the leg extending from the first surface of the base in a substantially perpendicular direction with respect to the first surface and the distal end being attached to an adjacent full-U-shaped arch of the plurality of full-U-shaped arches, the elongated flexible element being braided around the frame in a braiding pattern, such that the elongated flexible element is intertwined across the frame such that segments of the elongated element form curved and inclined flow channels of a variable cross section and openings between these segments on a burner surface, which provides a flame stabilization surface.

2. The burner according to claim 1, wherein the burner has the shape of a basket.

3. The burner according to claim 1, wherein the r plurality of full-U-shaped arches comprises an even number of full-U-shaped arches.

4. The burner according to claim 3, wherein the full-U-shaped arches do not cross each other.

5. A method for fabricating a burner for premixed gas-phase combustion, the method comprising:

providing an elongated flexible element made of multiple strands of yarn twisted together;

providing a frame comprising;

a holder having a first surface, a second surface, an outer wall, and an inner wall defining an aperture; and structural elements comprising;

a plurality of full-U-shaped arches, each full-U-shaped arch including two legs and each leg extending from the first surface of the base in a substantially perpendicular direction with respect to the first surface; and a single half-U-shaped arch having a leg and a distal end opposite the leg, the leg extending from the first surface of the base in a substantially perpendicular direction with respect to the first surface and the distal end being attached to an adjacent full-U-shaped arch of the plurality of full-U-shaped arches; and intertwining the elongated flexible element about the structural elements of the frame such that the elongated flexible element is braided around the frame in a braiding pattern and such that segments of the elongated flexible element form curved and inclined flow channels of a variable cross section between these segments on a burner surface, which provides a flame stabilization surface.

6. A burner for pre-mixed gas-phase combustion, the burner comprising:

a frame comprising:

a base having a first surface, a second surface, an outer wall, and an inner wall defining an aperture; and structural elements comprising:

a plurality of full-U-shaped arches, each full-U-shaped arch including two legs and each leg extending from the first surface of the base in a substantially perpendicular direction with respect to the first surface; and a single half-U-shaped arch having a leg and a distal end opposite the leg, the leg extending from the first surface of the base in a substantially perpendicular direction with respect to the first surface; and an elongated flexible element comprising multiple twisted strands of material, the elongated flexible element being intertwined about the frame to form a burner surface comprising curved and inclined flow channels.

7. The burner of claim 6, wherein the distal end of the single half-U-shaped arch is attached to an adjacent full-U-shaped arch of the plurality of full-U-shaped arches.

8. The burner of claim 6, wherein the multiple twisted strands of material comprise ceramic material.

9. The burner of claim 6, wherein each of the structural elements has a thickness that is less than a thickness of the elongated flexible element.

10. The burner of claim 6, wherein the curved and inclined flow channels have a variable cross section and segments of the elongated flexible element form openings on the burner surface.

* * * * *